United States Patent [19]

Sato

[11] 4,370,398

[45] Jan. 25, 1983

[54] ELECTROSTATIC COPYING PROCESS

[75] Inventor: Tsutomu Sato, Tokyo, Japan

[73] Assignee: Ricoh Company, Ltd., Tokyo, Japan

[21] Appl. No.: 141,514

[22] Filed: Apr. 18, 1980

[30] Foreign Application Priority Data

| | | | |
|---|---|---|---|
| Apr. 26, 1979 | [JP] | Japan | 54-51915 |
| Oct. 13, 1979 | [JP] | Japan | 54-131991 |
| Oct. 15, 1979 | [JP] | Japan | 54-131801 |

[51] Int. Cl.[3] ..... G03G 13/01; G03G 13/22

[52] U.S. Cl. ..... 430/42; 430/57; 430/54; 430/48

[58] Field of Search ..... 430/54, 55, 57, 48, 430/31, 42

[56] References Cited

U.S. PATENT DOCUMENTS

| | | | |
|---|---|---|---|
| 3,536,483 | 10/1970 | Watanabe et al. | 430/55 |
| 3,666,364 | 5/1972 | Marushima | 430/55 |
| 3,801,317 | 4/1974 | Tanaka et al. | 430/57 |
| 4,250,239 | 2/1981 | Sakai | 430/57 |

*Primary Examiner*—John E. Kittle
*Assistant Examiner*—John L. Goodrow
*Attorney, Agent, or Firm*—David G. Alexander

[57] ABSTRACT

A photoconductive member (21) is provided with inner (21*b*) and outer (21*c*) photoconductive layers. An electrostatic charge is formed at the interface of the layers (21*b*), (21*c*), either by a combination of applied charge and semiconductive current flow through the inner layer (21*b*) or applied charge and radiation with light having a wavelength selected to render only one of the inner (21*b*) and outer (21*c*) layers conductive. Then, the member (21) is radiated with a light image of an original document (26) to form an electrostatic image at the interface. The electrostatic image is repeatedly developed and the resulting toner images transferred to copy sheets (34). Another charge may be applied to the member (21) after the first charge to form electrostatic dipoles across the layers (21*b*), (21*c*). The charge magnitudes as well as charge dissipation time constants across the layers (21*b*), (21*c*) are selected such that an increase in the surface potential on the member (21) due to charge dissipation across the layers (21*b*), (21*c*) is equal to a decrease in the surface potential due to charge leakage in the developing and transfer steps as functions of time, thereby providing constant copy density and contrast.

8 Claims, 35 Drawing Figures

ELECTROSTATIC COPYING PROCESS

BACKGROUND OF THE INVENTION

The present invention relates to an improved electrostatic copying process for repeatedly developing and transferring toner images produced from a single electrostatic image.

Electrostatic copying processes are known in the art in which an electrostatic image is formed on a photoconductive member and repeatedly developed and the resulting toner images transferred to copy sheets. These processes provide large numbers of copies of a single original document at high speed since the charging and imaging steps only have to be performed once. The spectral sensitivity of practical photoconductive materials is generally low and limits the speed at which the imaging step may be performed.

However, a major problem has existed in the prior art in that there is a large amount of charge leakage during the developing and transfer steps which result in a progressive reduction in the electrostatic image surface potential and thereby the copy density and contrast.

A prior art expedient to overcome this problem is to provide a transparent insulating layer on the photoconductive member and form the electrostatic image at the interface of the photoconductive layer and the insulating layer. However, this method requires extra process steps and it is generally difficult to form the electrostatic layer at the interface of the photoconductive layer and insulating layer rather than on the surface of a photoconductive member having no insulating layer since polarity inversion is necessary.

Another prior art process utilizes the electrostatic memorization effect of various photosensitive materials. However, these materials have low sensitivity and the imaging process is complicated and difficult.

Another prior art process utilizes a material which undergoes irreversible chemical or physical change when radiated with a light image. Although this process is desirable for making many copies of a single original document, it is excessively expensive for making only one copy since the master plate is discarded.

SUMMARY OF THE INVENTION

An electrostatic copying process embodying the present invention comprises the steps of providing a photoconductive member having a substrate, an inner photoconductive layer formed on the substrate and an outer photoconductive layer formed on the inner layer, forming an electrostatic charge of a first polarity at an interface of the inner and outer layers, radiating a light image onto the outer layer to form an electrostatic image corresponding thereto at the interface through localized photoconduction, and repeatedly applying toner to the outer layer to form toner images thereon and transferring the toner images to respective copy sheets.

In accordance with the present invention, a photoconductive member is provided with inner and outer photoconductive layers. An electrostatic charge is formed at the interface of the layers either by a combination of applied charge and semiconductive current flow through the inner layer or applied charge and radiation with light having a wavelength selected to render only one of the inner and outer layers conductive. Then, the member is radiated with a light image of an original document to form an electrostatic image at the interface. The electrostatic image is repeatedly developed and the resulting toner images transferred to copy sheets. Another charge may be applied to the member after the first charge to form electrostatic dipoles across the layers. The charge magnitudes as well as charge dissipation time constants across the layers are selected such that an increase in the surface potential on the member due to charge dissipation across the layers is equal to a decrease in the surface potential due to charge leakage in the developing and transfer steps as functions of time, thereby providing constant copy density and contrast.

It is an object of the present invention to provide an improved electrostatic copying process which produces large numbers of copies of a single original document with high and constant quality.

It is another object of the present invention to provide an improved electrostatic copying process which is usable for making single copies or multiple copies in a selective manner.

It is another object of the present invention to provide a generally improved electrostatic copying process.

Other objects, together with the foregoing, are attained in the embodiments described in the following description and illustrated in the accompanying drawing.

DESCRIPTION OF THE PREFERRED EMBODIMENTS

While the electrostatic copying process of the present invention is susceptible of numerous physical embodiments, depending upon the environment and requirements of use, substantial numbers of the herein shown and described embodiments have been made, tested and used, and all have performed in an eminently satisfactory manner.

Figure 1:
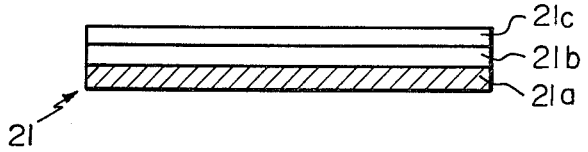
FIG. 1 is a fragmentary sectional view of a photoconductive member used in practicing the present invention.

Referring now to FIG. 1 of the drawing, a photoconductive member embodying the present invention is generally designated by the reference numeral 21 and comprises an electrically conductive substrate 21*a*, a first or inner photoconductive layer 21*b* formed on the substrate 21*a* and a second or outer photoconductive layer 21*c* formed on the first layer 21*b*. The substrate 21*a* may be formed of any material having a resistivity of less than $10^{10}$ ohms per centimeter such as aluminum, zinc, copper, lead, tin oxide, copper iodine, chromuim oxide, or plastic or glass coated with a metal or metal compound as indicated above.

The layer 21*b* is photoconductive in response to light of a first color or wavelength range designated as A. However, the layer 21*b* is insensitive to light of a second color or wavelength range B.

The layer 21*c* is sensitive to light of the color B and transmits light of the color A. The layer 21*c* may or may not be sensitive to light of the color A. The wavelength ranges A and B may be continuous or discontinuous.

As another alternative, the layer 21*b* may be sensitive to light of the color B and the layer 21*c* provided with a dye or filter layer which absorbs light of the color B. The effect is the same since light of the color B will not cause photoconduction of the layer 21*b*. It is also possible to provide an intermediate layer between the layers 21*b* and 21*c*.

Figure 2A:
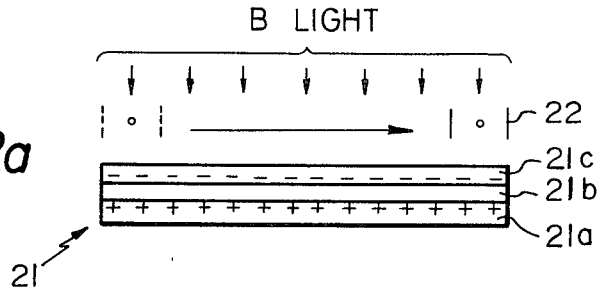
FIGS. 2*a* to 2*d* are diagrams illustrating an electrostatic copying process embodying the present invention.
Figure 2B:
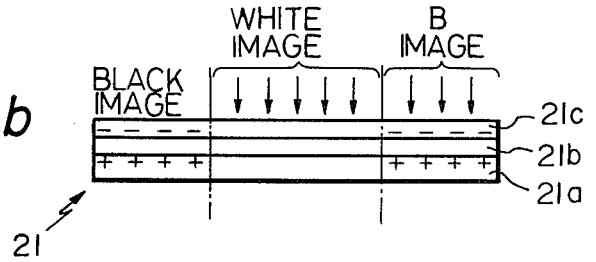
Figure 2C:
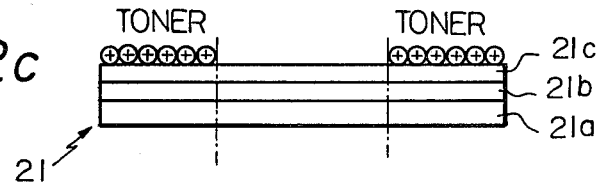
Figure 2D:
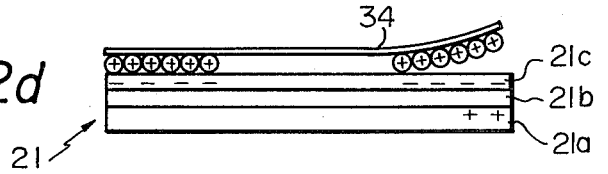
Figure 3:
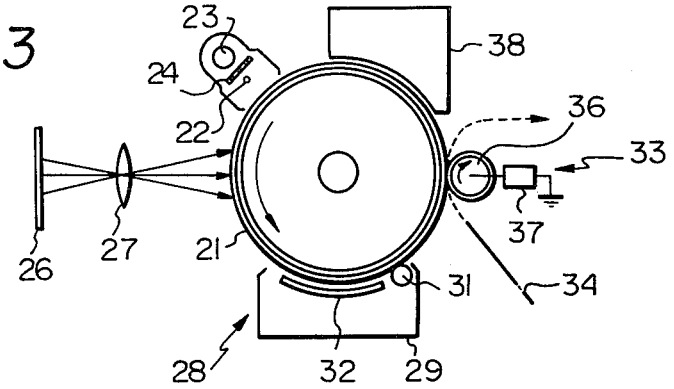
FIG. 3 is a schematic view of an electrostatic copying apparatus used for practicing the process of FIGS. 2*a* to 2*d;*

An electrostatic copying apparatus for practicing the present process is illustrated in FIG. 3 whereas the process steps are illustrated in FIGS. 2*a* to 2*d*.

In the first step of the process, shown in FIG. 2*a*, a photoconductive drum corresponding to the photoconductive member 21 is simultaneously charged to a negative polarity by a corona charging unit 22 and radiated with B color light by means of a white light source 23 and a filter 24 which selectively transmits only the B color light. This results in the formation of a negative charge at the interface of the layers 21*b* and 21*c*, since only the layer 21*c* is rendered photoconductive by the B color light.

In the next step of the process, which is illustrated in FIG. 2*b*, a light image of an original document 26 is radiated onto the drum 21 by means of an optical system which is symbolically illustrated as being in the form of a converging lens 27.

This step results in the formation of an electrostatic image at the interface of the layers 21*b* and 21*c* due to localized photoconduction. In black image areas there is no photoconduction and the negative charge at the interface of the layers 21*b* and 21*c* remains unchanged. In white image areas, the entire charge is dissipated due to photoconduction of both layers 21*b* and 21*c* since white light contains both colors A and B. In a B color image area, only the layer 21*c* is rendered photoconductive. However, the charge remains in this area since there is no photoconduction in the layer 21*c*.

Then, as illustrated in FIG. 2*c*, toner is applied to the drum 21 by a semimoist developing unit 28 which typically comprises a developing tank 29 containing toner, an applicator roller 31 and a biasing electrode 32. The toner is charged with a positive polarity so as to adhere to the negative electrostatic image areas. As shown in FIG. 2*c*, the toner adheres to both the black and B color image areas since both have negative charge.

In the next step of FIG. 2*d*, a transfer unit 33 transfers the toner image to a copy sheet 34 to which the toner image is fixed by a fixing unit which is not shown. The transfer unit 33 typically comprises an electrically conductive roller 36 covered with an electrically insulative layer and a bias voltage source 37 which applies a bias or transfer voltage to the roller 36.

The units 22, 23, 24 and 27 are used only for making the first copy. It will be understood that the electrostatic image remains at the interface of the layers 21*b* and 21*c* because there is no physical contact between the electrostatic image and the toner or copy sheet 34 and therefore no charge leakage. In other words, the electrostatic image is intact and may be used to make a large number of additional copies.

This is done by energizing only the developing unit 28 and transfer unit 33 and continuing the rotation of the drum 21. The electrostatic image is developed to produce a toner image once for each revolution of the drum 21 and the resulting toner image transferred to a respective copy sheet 34. After the last copy is made, a cleaning unit 38 is energized to dissipate the electrostatic image and remove residual toner from the drum 21.

Where the layer 21*b* is formed of selenium or some other material which has a semiconductive property, it may be difficult to hold the negative charge at the interface of the layers 21*b* and 21*c* because selenium is semiconductive in the opposite direction. In other words, selenium has very low resistance to negative charge and would allow the negative charge at the interface of the layers 21*b* and 21*c* to dissipate into the substrate 21*a*. This may be overcome by providing a charge holding intermediate layer at the interface of the layers 21*b* and 21*c* or as part of either of the layers 21*b* and 21*c*.

It will be seen that the drawbacks of the prior art are overcome since the electrostatic image is not dissipated by leakage in the developing and transfer steps. This is because the electrostatic image never physically contacts the toner or copy sheet 34. For this reason, the present invention is capable of producing a large number of excellent copies of the document 26 with only one charging and imaging step, therefore providing substantially increased speed and quality over the prior art.

It may occur in some applications that the surface potential will still decrease as a function of time and cause a reduction in the copy density and contrast. This is due to induced charge and other factors in the developing and transfer steps. The present invention further comprises means to compensate for this effect and provide constant copy density and contrast over a long period of time as will be described in detail below.

Figure 4:
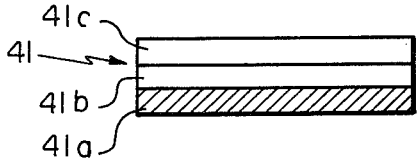
FIG. 4 is a fragmentary sectional view of another photoconductive member in accordance with the present invention.

Referring now to FIG. 4, another photoconductive member embodying the present invention is designated as 41 and comprises a conductive substrate 41*a*. A first photoconductive layer 41*b* is formed on the substrate 41*a* and a second photoconductive layer 41*c* is formed on the first layer 41*b*. The first layer 41*b* is sensitive to A color light and is semiconductive in that it has low resistance to positive charge (hole) flow from the substrate 41*a* to the second layer 41*c* therethrough. The second layer 41*c* is insensitive to but transmits A color light and is sensitive to B color light.

Figure 6A:
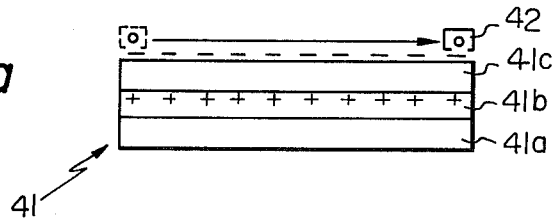
FIGS. 6*a* to 6*d* are schematic views illustrating another electrostatic copying process embodying the present invention using the photoconductive members of FIGS. 4 and 5.
Figure 11:
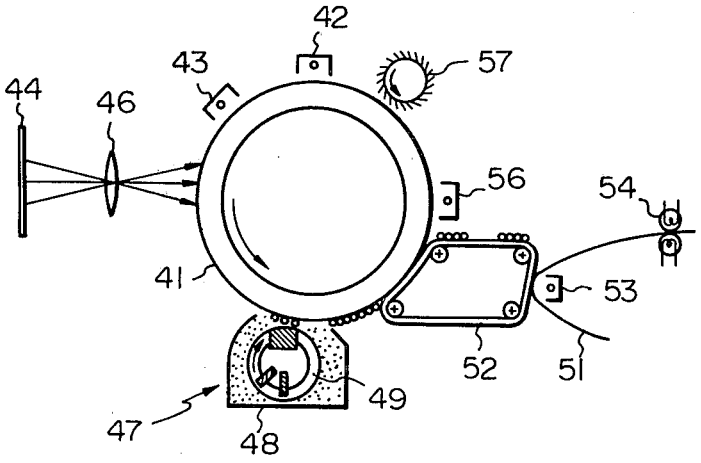
FIG. 11 is a schematic view of an electrostatic copying apparatus for practicing the present processes.

FIG. 11 illustrates an electrostatic copying machine for practicing the present method whereas the process steps are illustrated in FIGS. 6*a* to 6*d*. The first step, shown in FIG. 6*a*, is to charge the photoconductive member, shown in the form of a drum 41, with a negative charge by means of a corona charger 42. This results in the formation of a negative charge on the surface of the second layer 41*c*. This charge induces positive charge (hole) flow from the substrate 41*a* to the interface of the layers 41*b* and 41*c* due to the semiconductive property of the layer 41*b*.

Figure 7:
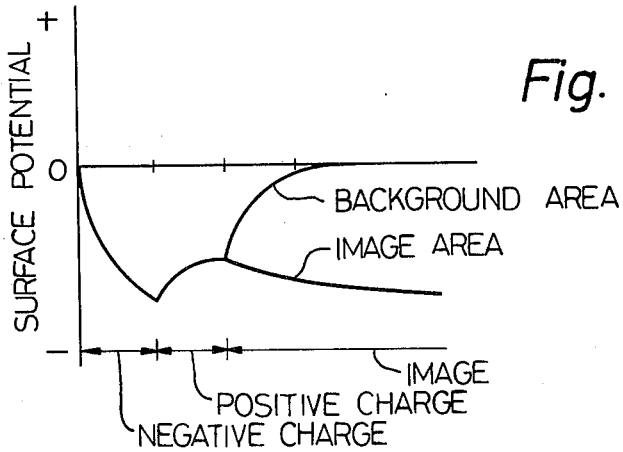
FIG. 7 is a graph illustrating the process of FIGS. 6*a* to 6*d;*
Figure 6B:
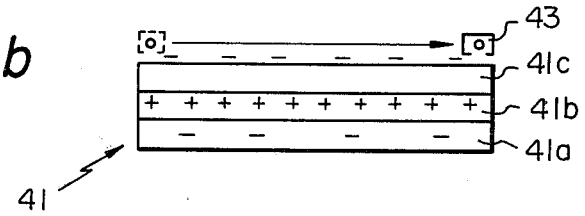

In the next step of FIG. 6*b*, a corona charger 43 applies a positive charge to the drum 41. As shown in FIG. 7, the magnitude of the positive charge is relatively low and does not reverse the surface potential of the drum 41 from negative to positive but merely reduces the negative potential to a lower magnitude. This second charging results in the formation of oppositely oriented charge dipoles across the layers 41*b* and 41*c*.

Figure 6C:
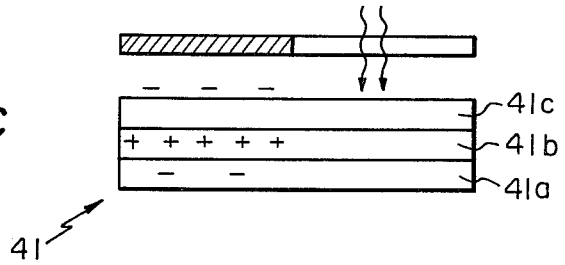

In the next step of the process, as shown in FIG. 6*c*, a light image of an original document 44 is radiated onto the drum 41 by means of a lens 46. This causes no photoconduction in black image areas and conduction of both layers 41*b* and 41*c* in white image areas. Thus, the potential in the white image areas is reduced to zero while the potential in the black image areas is uneffected.

Figure 6D:
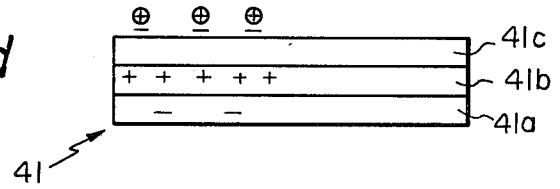

After imaging, a magnetic brush developing unit 47 comprising a developing tank 48 and a rotating applicator cylinder 49 applies toner to the drum 41 to form a toner image as shown in FIG. 6*d*. The toner image is transferred to a copy sheet 51 via an intermediate transfer belt 52 and a transfer charger 53. A fixing unit 54 comprising flash lamps fixes the toner image to the copy sheet 51.

The developing and transfer steps are repeated until the desired number of copies have been produced. Thereafter, the drum 41 is discharged by a discharger 56 and cleaned by a cleaning unit 57.

As discussed hereinabove, the absolute magnitudes of the charges across the layers 41*b* and 41*c* decrease as functions of time. It is a novel and unique feature of the present invention to select the magnitudes of the charges applied by the chargers 42 and 43 and the charge dissipation time constants or dark attenuation rates of the layers 41*b* and 41*c* so that the charges across the layers 41*b* and 41*c* dissipate at different rates. The differential charge dissipation is selected to increase the surface potential of the member or drum 41 at a rate which is equal to the decrease in surface potential caused by leakage during development and transfer.

Since the electrostatic image is dominated by the negative charge at the surface of the layer 41*c*, and the charges across both layers 41*b* and 41*c* decrease or dissipate with time, the charge across the layer 41*b* must dissipate faster than the charge across the layer 41*c* to maintain the surface potential on the member 41 at a constant value.

The instantaneous surface potential across the layer 41*b* is designated as $V_1$ whereas the instantaneous surface potential across the layer 41*c* is $V_2$. The initial surface potentials across the layers 41*b* and 41*c* after conclusion of charging by the charger 43 are $V_1^0$ and $V_2^0$ respectively. The charge dissipation time constant across the layer 41*b* is $r_1c_1$ whereas the charge dissipation time constant across the layer 41*c* is $r_2c_2$. The following relations hold for $V_1$ and $V_2$.

$$V_1 = V_1^0 e^{-\left(\frac{1}{r_1c_1}\right)t} \quad (1)$$

$$V_2 = V_2^0 e^{-\left(\frac{1}{r_2c_2}\right)t} \quad (2)$$

where t is time and e indicates exponentation.

The surface potential V on the drum 41 is $$V = V_1 + V_2 = V_1^0 e^{-\left(\frac{1}{r_1c_1}\right)} + V_2^0 e^{-\left(\frac{1}{r_2c_2}\right)t} \quad (3)$$

The surface potential V without leakage during development and transfer will increase as a function of time if the following relation holds, $$\frac{r_1c_1}{r_2c_2} < -\frac{V_1}{V_2} < 1 \quad (4)$$

V can be maintained constant by optimal selection of $V_1^0$, $V_2^0$, $r_1c_1$ and $r_2c_2$ so that $(dV/dt)=0$.

Figure 5:
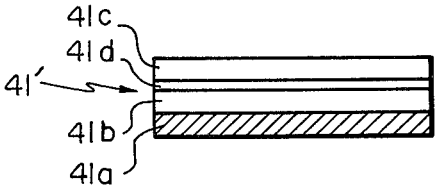
FIG. 5 is similar to FIG. 4 but shows a modified photoconductive member.

FIG. 5 illustrates another photoconductive member which may be substituted for the member 41 and is designated as 41'. The member 41' comprises an intermediate layer 41*d* disposed between the layers 41*b* and 41*c*.

Typical materials for the layer 41*b* are Se, Te-doped Se, ZnO, $TiO_2$, CdS and metalphthalocyanine with or without addition of dyestuffs, pigments or known sensitizers. The layer 41*b* may be deposited by any ordinary techniques including evaporation, sputtering resin-dispersed (dissolved) application, dissolution coating or emulsion coating.

A binder resin used for the resin-dispersed (dissolved) application may be selected from polyamino acid resin (e.g. poly-r-carbazolylethyl-L-glutamate (PCLG)), polyester resin, polycarbonate resin, styrene resin, acrylic resin, chloridized polyethylene, styrenebutadien copolymer, acetal resin, butyral resin, polyamid resin, unsaturated polyester resin, urethane resin, epoxy resin and melamine resin.

Another effective type of first photoconductive layer 41*b* is a so-called stratified photoconductive layer which uses the above-mentioned layer as a charge generating layer and has a charge transferring layer deposited on the charge generating layer and made up of the aforesaid binder resin and an organic electronic material (electron supplier and electron receiver).

The electron supplier (electron supplying substance) may be selected from compounds each including at least one alkyl group such as methyl group, alkoxy group, amino group, imino group and imido group, and low molecular weight electron supplying compounds having in their straight chains or side chains a polycyclic aromatic compound such as anthracene, pyrene, phenanthrene or coronene or a nitrogen-containing cyclic compound such as indole, carbozole, oxazole, isooxazole, thiazole, imidazole, pyrazole, oxadiazole, thiadiazole or triazole. Practical example are hexamethylenediamine, N-(4-aminobutyl)cadaverine, asdidodecylhydrazine, p-toluidine, 4-amino-o-xylene, N,N'-diphenyl1, 2-diaminoethane, o-, m- or p-ditolylamine, triphenylamine, durene, 2-bromo-3,7-dimethylnaphthalene, 2,3,5-trimethylnaphthalene, N'-(3-bromophenyl)-N-(β-naphthyl) urea, N'-methyl-N-(α-naphthyl) urea, N,N'-diethyl-N-(α-naphthyl) urea, 2,6-dimethylanthracene, anthracene, 2-phenylanthracene, 9,10-diphenylanthracene, 9,9'-bianthranyle, 2-dimethylaminoanthryacene, phenanthrene, 9-aminophenanthrene, 3,6-dimethylphenanthrene, 5,7-dibromo-2-phenylindole, 2,3-dimethylindoline, 3-indolylmethlyamine,carbazole, 2-methylcarbazole, N-ethylcarbazole, 9-phenylcarbazole, 1,1'-dicarbazole, 3-(p-methoxyphenyl)oxazolidine, 3,4,5-trimethylisooxazole, 2-anilino-4,5-diphenylthiazole, 2,4,5-trinitrophenylimidazole, 4-amino-3,5-dimethyl-1-phenyl pyrazole, 2,5-bi(dimethylaminophenyl)-1,3,4-oxadiazole, 1,3,5-triphenyl-1,2,4-triazole, 1-amino-5-phenyltetrazole, and bis-diethylaminophenyl-1,3,6-oxadiazole. Also available are high molecular weight electron supplying compounds typified by poly-N-vinylcarbazole and its derivatives (e.g. derivatives having in their carbazole skeleton a halogen such as chlorine, bromine or the like or methyl group, amino group or like substituent group), polyvinylpyrene, polyvinylanthracene, pyrene-formaldehyde condensation polymer and its derivative (e.g. one having in its pyrene skeleton a halogen such as bromine or a substitutent group such as nitrogen group).

The electron receiver (electron receiving substance) may be selected from anhydrous maleic acid, anhydrous phthalic acid, tetrachlorophthalic anhydride, tetrabromophthalic anhydride, naphthalic anhydride, pyromellitic anhydride, chloro-p-benzoquinone, 2,5-dichlorobenzoquinone, 2,6-dichlorobenzoquinone, 5,8-dichloronaphthoquinone, o-chloroanile, o-buromoanile, p-chloroanile, p-buromoanile, p-iodineanile, tetracyanoquinodimethane, 5,6-quinolinedione, cumarin-2,2-dion, oxyindirubin, oxyindigo, 1,2-dinitroethane, 2,2-dinitropropane, 2-nitro-2-nitrosopropane, iminodiacetonitril, succinonitril, tetracyanoethylene, 1,1,3,3-tetracyanopropenid, o- or m- or p-dinitrobenzene, 1,2,3-trinitrobenzene, 1,2,4-trinitrobenzene, 1,3,5-trinitrobenzene, dinitrodibenzile, 2,4-dinitroacetophenon, 2,4-dinitrotoluene, 1,3,5-trinitrobenzophenon, 1,2,3-trinitroanisole, α,β-dinitronaphthalene, 1,4,5,8-tetranitronaphthalene, 3,4,5-trinitro-1,2-dimethylbenzene, 3-nitroso-2-nitrotoluene, 2-nitroso-3,5-dinitrotoluene, o-, m- or p-nitronitrosobenzene, phthalonitrile, terephthalonitrile, isophthalonitrile, benzoil cyanide, bromobenzil cyanide, quinoline cyanide, o-xylene cyanide, o-, p- or m-nitrobenzile cyanide, 3,5-dinitropyridine, 3-nitro-2-pyridine, 3,4-dicyanopyridine, α-, β- or γ-cyanopyridine, 4,6-dinitroquinone, 4-nitroxanthone, 9,10-dinitroanthracene, 1-nitroanthracene, 2-nitrophenanthrenequinone, 2,5-dinitrofluorenone, 3,6-dinitrofluorenone, 2,7-dinitrofluorenone, 2-methoxy-5,7-dinitrilfluorenone, 2,4,7-trinitrofluorenone, 2,4,5,7-tetranitrofluorenone, 3,6-dinitrofluorenonemandenonitrile, 3-nitrofluorenonemandenonitrile and tetracyanophyrene.

Overlying the first photoconductive layer 41b or the intermediate layer 41d, the second photoconductive layer 41c is formed of a photoconductive material which transmits A color light and has no or substantially no sensitivity in the wavelength range of A color light while being sensitive to B color light. Practical examples of such a material are dian Blue belonging to the azo-pigment group, indigo belonging to the indigo pigment group, copper phthalocyanine belonging to the phthalocyanine pigment group and other organic blue photoconductive substances. Other examples are substances containing as their spectral sensitizers methylene Blue of the thiazine dyestuff group, 1,3,5-triphenylthiapyrylium perchlorate of the thiapyrylium salt group, tetrabromophenol Blue of the triphenylmethane dyestuff group and like blue dyestuffs (e.g. polyvinilcarbazole or the like sensitized by 1,3,5-triphenylthiapyrylium perchlorate or zinc oxide or the like sensitized by tetrabromophenol Blue). Still other examples are eutectic crystal complexes prepared from, for example, thiapyrylium salt and polycarbonate, etc.

As mentioned in connection with the layer 41b, the layer 41c may be provided with a stratified structure having a charge generating layer and a charge transferring layer. A method for depositing the layer 41c can be selected from any of those applicable to the deposition of the layer 41b.

Concerning the intermediate layer 41d, preferred examples are the aforementioned organic compounds such as binder resin and inorganic white or transparent compounds such as SiO, $SiO_2$, $Al_2O_3$, MgO and $MgF_2$. If necessary, a photoconductive material of a nature enhancing the carrier injection efficiency (e.g. zinc oxide or phthalocyanine pigment) or the aforementioned organic electronic material may be added to a selected one of the substances stated above.

A suitable red or blue pigment or dyestuff may be added to the intermediate layer 41d. Typical examples of the pigment are indigo pigments such as indigo and thioindigo, azo pigments such as pyrazolone red, anthraquinone pigments such as indianthrene blue, quinacridone pigments, perylene pigments and other organic pigments; and inorganic pigments such as copper sulfate, potassium ferrosyanate, barium bichromate, cobalt sulfate, cobalt carbonate, trichloromolybudenum, potassium ferricyanide, selenium powder, tin iodide, red iron oxide, mercury oxide, cobalt blue and the like. Examples of the dyestuff are diphenylmethane dyes such as auramine, triphenylmethane dyes such as crystal violet and malachite green, xanthene dyes such as fluorescein, rose bengale and rhodamine B, acridine dyes such as acrydine orange, azine dyes such as phenosafranine and methylene violet, thiazine dyes such as phenothiazine and methylene blue, pyrylium salts such as 1,3,5-triphenylthiapyrylium perchrolate, and thiapyrylium salts such as 1,3,5-triphenylthiapyrylium perchrolate.

Such a pigment or a dyestuff will be blue when the B color is red and red when the B color is blue.

To form the member 41 or 41', liquid compositions for the individual photoconductive layers 41b and 41c are prepared (or a liquid composition for the layer 41c alone is prepared while depositing the layer 41b by evaporation), with or without an additional liquid composition for the intermediate layer 41d (which may be formed by evaporation). Thereafter, the first photoconductive layer 41b is formed on the substrate 41a and then the second photoconductive layer 41c with or without the intermediate layer 41d intervening between the two layers 41b and 41c by such a technique as application and drying or evaporation. The first photoconductive layer 41b is 10–150 μm thick, the intermediate layer 41d 0.3–5.0 μm thick, and the second photoconductive layer 41c 10–100 μm thick. It will be noted that an organic solvent used for this process must be capable of dissolving a binder and, thus, may favorably comprise toluene, tetrahydrofuran, 1,2-dichloroethane, benzene, methanol or the like.

The toner may be in the form of iron particles coated with resin and having diameters ranging from 100 to 250 microns in diameter or ferrite particles having the same diameter. The belt 52 may formed of silicone or silicone rubber based on polysiloxane coated on a metal core or directly formed into a belt.

Figure 12:
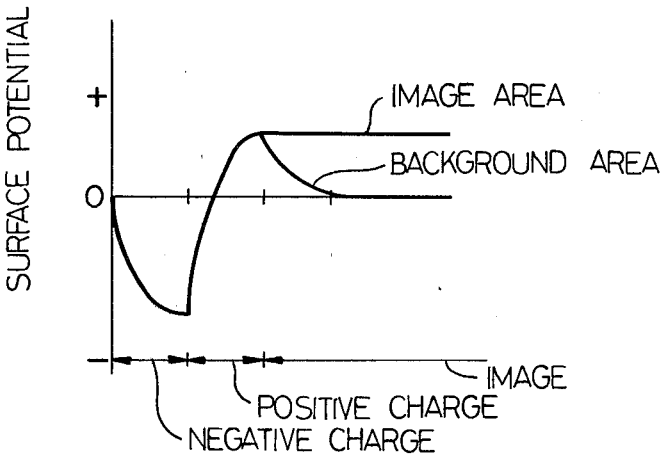
FIG. 12 is a graph illustrating the process of FIGS. 10*a* to 10*d;*

FIGS. 10*a* to 10*d* illustrate another process of the present invention having steps corresponding to FIGS. 6*a* to 6*d* respectively. The surface potential on the drum is illustrated in FIG. 12.

Figure 10A:
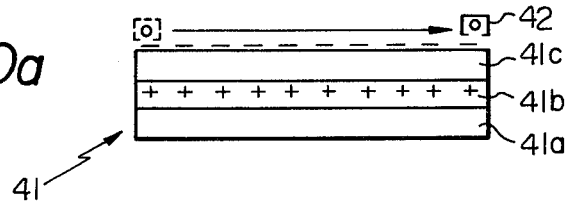
FIGS. 10*a* to 10*d* are schematic views illustrating another electrostatic copying process embodying the present invention.
Figure 10B:
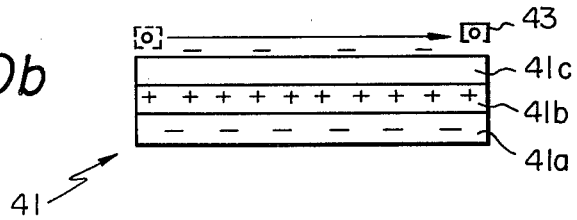
Figure 10C:
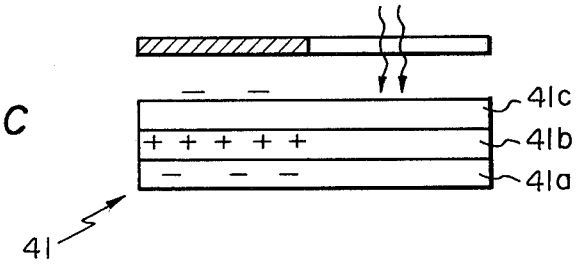
Figure 10D:
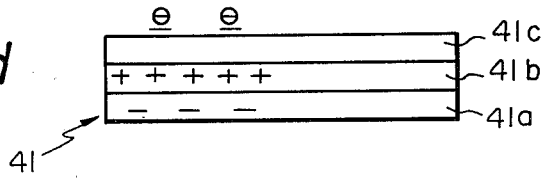

The main difference between the process of FIGS. 10*a* to 10*b* and the process of FIGS. 6*a* to 6*d* is that in FIGS. 10*a* to 10*d* the magnitude of the charge applied by the charger 43 is large enough in magnitude to reverse the surface potential from negative to positive. In this case, it is desired to have the positive potential increase with time to compensate for charge dissipation during development and transfer. Thus, the charge across the outer photoconductive layer must dissipate faster than the charge across the inner photoconductive layer. This is accomplished by the following relation and optimal selection as above so that (dV/dt)=0.

$$\frac{r_1c_1}{r_2c_2} > -\frac{V_1}{V_2} > 1 \qquad (5)$$

The present invention will further be described in conjunction with some examples.

EXAMPLE 1

Se was vacuum-deposited to a thickness of about 40 μm on a 0.2 mm Al substrate (conductive substrate) which was maintained at 70° C. Then a Se alloy containing 10 Wt% of Te was vacuum-deposited on the first Se layer to a thickness of about 5 μm while holding the Al substrate at the same temperature, thus forming a first photoconductive layer.

A methanol solution of a novolak type phenol resin (CP-918 available from Gunnei Kagaku K.K.) was applied by dipping to the first photoconductive layer whereupon the mass was dried 1 hour at 50° C. to obtain about a 1.2 μm thick intermediate layer. This intermediate layer was applied with a solution whose composition was as follows:

- 4-p-dimethylaminophenyl-2,6-diphenylthiapyrilium perchlorate—0.2 g
- 4,4'-bis(diethylamino)-2,2'-dimethyltriphenylmethane—4.0 g
- polycarbonate resin (Lexan 141-111 available from General Electric)—5.8 g
- methylene chloride—100 g Thereafter, the mass was dried 20 minutes at 50° C. to form a second photoconductive layer which was measured to be about 22 μm thick.

Figure 8:
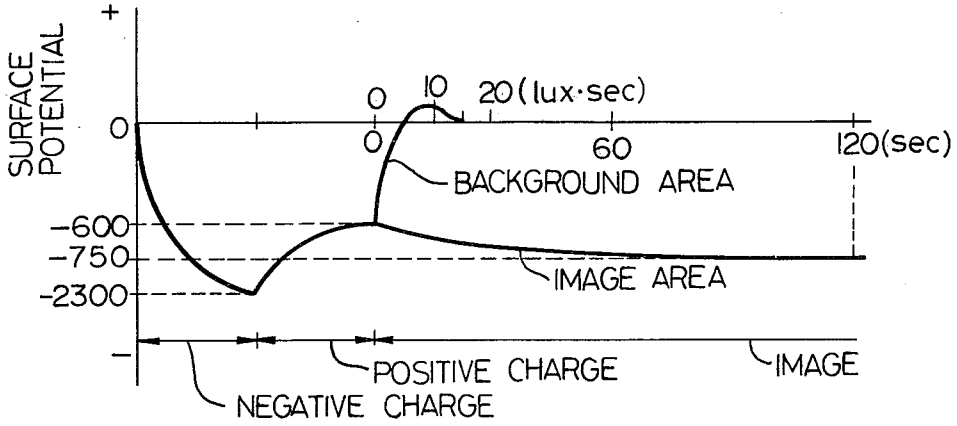
FIGS. 8 and 9 are graphs illustrating practical examples of the present electrostatic copying processes.

The photoconductive member was charged to −2300 V in the dark by a corona charger and then charged positively to a surface potential of −600 V. Subsequent imaging caused the surface potential on the member to vary as shown in FIG. 8.

When the member was mounted in a copying machine of the type shown in FIG. 11 and operated to provide multiple copies (copying rate: 40 copies/minute), densities on copies were measured as indicated in Table 1.

TABLE 1

| | Density | |
|---|---|---|
| | Image Area | Background |
| 1st copy | 1.17 | 0.09 |
| 50th copy | 1.22 | 0.09 |
| 100th copy | 1.25 | 0.08 |
| 200th copy | 1.20 | 0.08 |

EXAMPLE 2

A Mylar film with Al evaporated thereon (conductive substrate) was applied with a dispersed solution of the following composition:

- zinc oxide—15 g
- 50% xylene solution of styrenebutylacrylate copolymer—20 g (PRA 766 available from Nihon Raihi K.K.)
- toluene—15 g
- eosine B—20 g
- methanol—2 g The film was then dried 20 minutes at 100° C. to obtain an about 30 μm thick first photoconductive layer. A polyester resig (PEAD 49000 available from Du Pont) was applied by dipping onto the first photoconductive layer whereupon the mass was dried to form about a 0.8 μm intermediate layer thereon. Applied to the intermediate layer was a dispersion of the following composition:

- 4-p-dimethylaminophenyl-2,6-diphenylthiapyrylium perchlorate—0.4 g
- 4,4'-bis(diethylamino)-2,2'-dimethyltriphenylmethane—3.8 g
- polycarbonate resin (GE's Lexan 141-11)—5.8 g
- methylene chloride—100 g The mass eas dried 10 minutes at 80° C. to form a charge generating layer (about 5.5 μm thick) of a second photoconductive layer. This charge generating layer was applied with a solution of the following composition:

- 4,4'-bis(diethylamino)-2,2'-dimethyltriphenylmethane—5 g
- polycarbonate resin—5 g
- methylene chloride—90 g The mass was dried 10 minutes at 80° C. to form a charge transferring layer (about 20 μm) of a second photoconductive layer.

The charge generating and transferring layers constituted a second photoconductive layer.

Figure 9:
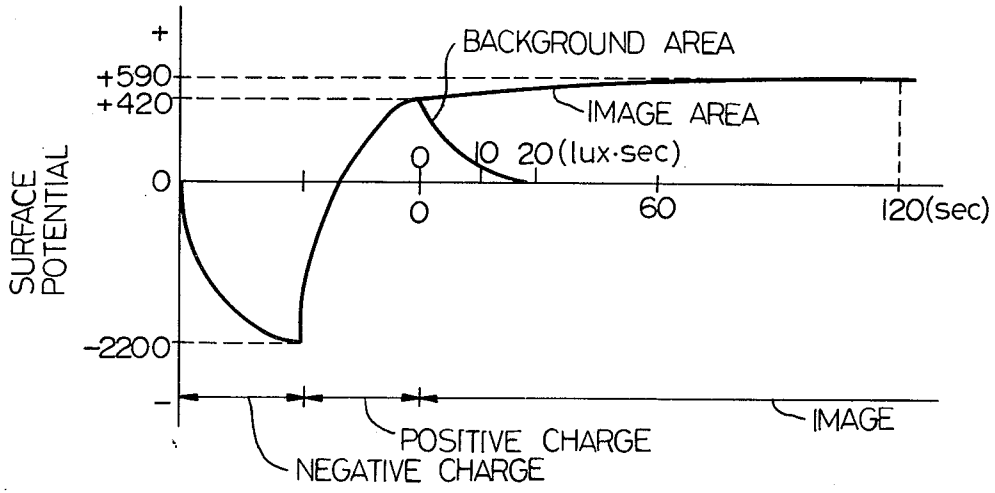

The resultant composite member was charged to −2200 V in the dark and then charged positively to form a +420 V potential on its surface, followed by exposure to a light image. The surface potential on the member was measured as indicated in FIG. 9.

This member was mounted in a copying machine of the type shown in FIG. 11 and operated to provide multiple copies (copying rate: 50 copies/minute). Copies had densities indicated in Table 2. A developer employed for said copying process was a mixture of a carrier in the form of iron dust with an average particle size of 100 μm and coated with teflon to about 2 μm and a toner (Ricoh PPC toner type 600).

TABLE 2

| | Density | |
|---|---|---|
| | Image Area | Background |
| 1st copy | 1.22 | 0.09 |
| 50th copy | 1.29 | 0.09 |

TABLE 2-continued

| | Density | |
|---|---|---|
| | Image Area | Background |
| 100th copy | 1.34 | 0.09 |
| 200th copy | 1.37 | 0.08 |

Figure 13:
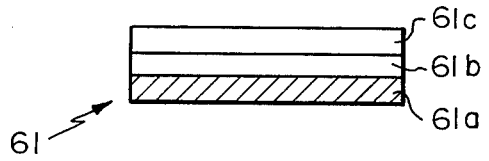
FIGS. 13 and 14 are fragmentary schematic views of photoconductive members for practicing another process of the present invention.
Figure 14:
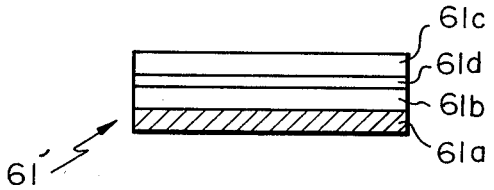

FIG. 13 illustrates another photoconductive member for practicing the present invention which is generally designated as 61 and comprises a conductive substrate 61*a*. A first photoconductive layer 61*b* which is sensitive to A color light and insensitive to B color light is formed on the substrate 61*a*. A second photoconductive layer 61*c* which is sensitive to B color light and insensitive to A color light is formed on the layer 61*b*. The layer 61*c* transmits the A color light.

Figure 15A:
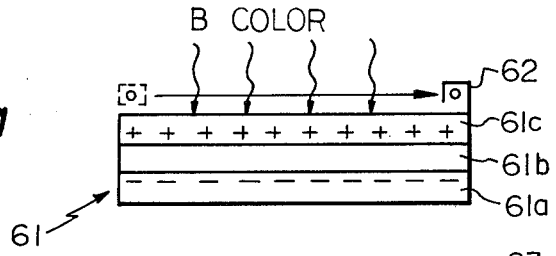
FIGS. 15*a* to 15*d* are schematic views illustrating an electrostatic copying process utilizing the photoconductive members of FIGS. 13 and 14.

In a first step of the process illustrated in FIG. 15*a*, the member 61 is radiated with B color light and simultaneously charged to a positive polarity by a corona charge 62. This causes photoconduction of only the layer 61*c* and the formation of a positive charge at the interface of the layers 61*b* and 61*c*.

Figure 16:
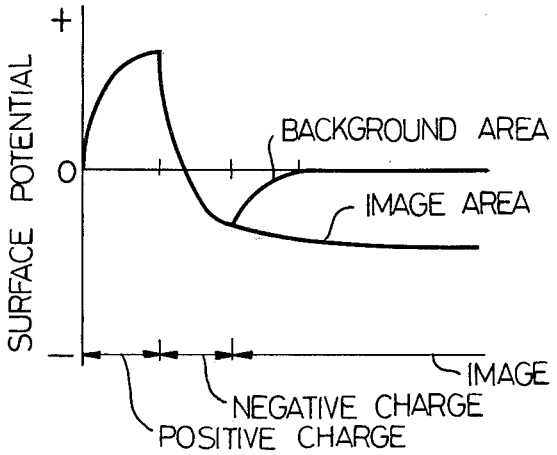
FIG. 16 is a graph illustrating the process of FIGS. 15*a* to 15*b;*
Figure 15B:
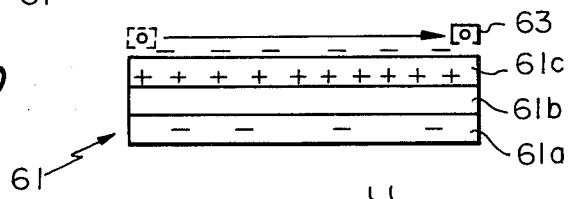

In the next step of FIG. 15*b*, a negative charge is applied to the member 61 by a corona charger 63. This results in the formation of oppositely oriented dipole charges across the layers 61*b* and 61*c*. The magnitude of the charge applied by the charger 63 is sufficient to reverse the polarity on the member 61 as shown in FIG. 16.

Figure 15C:
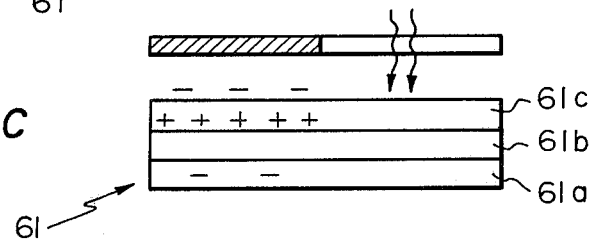
Figure 15D:
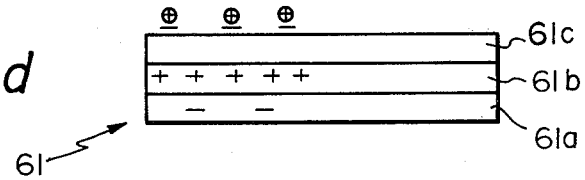
Figure 18:
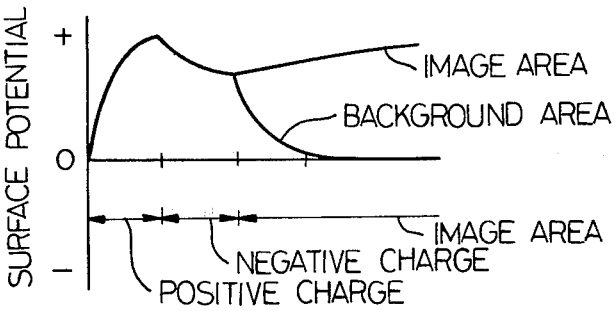
FIG. 18 is a graph illustrating the process of FIGS. 17*a* to 17*d*.
Figure 17A:
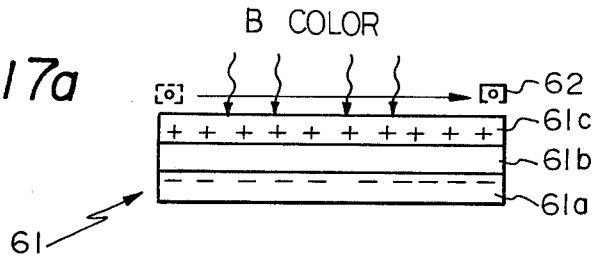
FIGS. 17*a* to 17*b* are graphs illustrating another electrostatic copying process embodying the present invention.
Figure 17B:
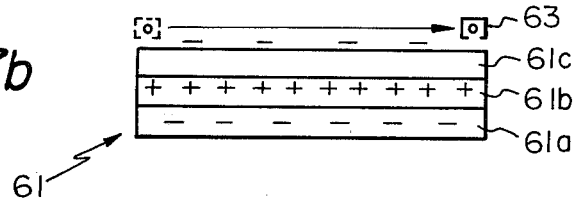
Figure 17C:
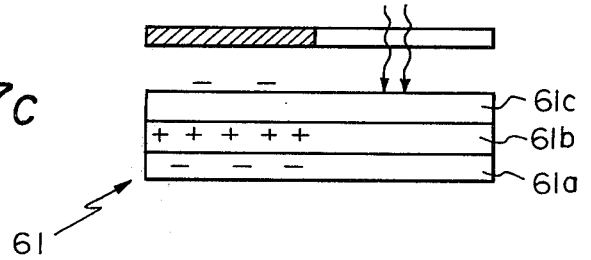
Figure 17D:
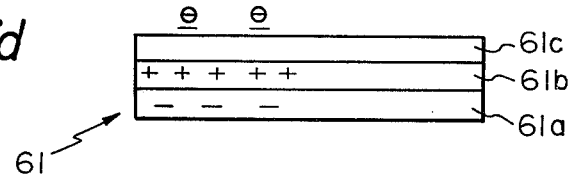

The third step of FIG. 15*c* is to radiate a light image onto the member. Both layers 61*b* and 61*c* conduct in the white image area while neither of the layers 61*b* and 61*c* conducts in the black image area. In the step of FIG. 15*d* a positive toner is applied to the member 61 for development.

Since the negative surface potential is to be maintained constant, the layer 61*b* must dissipate charge faster than the layer 61*c*. The following relation is used.

$$\frac{r_1c_1}{r_2c_2} < -\frac{V_1}{V_2} < 1 \qquad (6)$$

Another process illustrated in FIGS. 17*a* to 17*d* and FIG. 18 is similar to the process of FIGS. 15*a* to 15*d* except that the negative charge is insufficient to reverse the surface potential. In this case, the positive potential is to be maintained and the outer layer 61*c* must dissipate charge faster than the inner layer 61*b*. Thus, the following relation is used.

$$\frac{r_1c_1}{r_2c_2} > -\frac{V_1}{V_2} > 1 \qquad (7)$$

A material for the layer can be selected from the following, where the B color is red.

(1) photoconductive materials sensitive to red light ($\lambda \geqq 600$ nm) including organic blue photoconductive substances such as dian blue of the azo pigment group, indigo of the indogo pigment group and copper phthalocyanine of the phthalocyanine pigment group, substances containing as their spectral sensitizers such blue dyestuffs as methylene blue of the thiazine dyestuff group, 1,3,5-triphenylthiapyrylium perchlorate of the thiapyrylium salt group and tetrabromophenyl blue of the triphenylmethane dyestuff group (e.g. polyvinilcarbazole sensitized by 1,3,5-triphenylthiapyrylium perchlorate or zinc oxide sensitized by tetrabromophenol blue), and cocrystalline complex compounds prepared from thiapyrylium salts and polycarbonate;

(2) photoconductive materials sensitive to non-red light ($\lambda < 600$ nm) including yellow or red photoconductive substances typified by inorganic amorphous selenium, cadmium sulfide, cadmium selenide, zinc oxide, zinc sulfide and titanium dioxide (particularly $TiO_2$ of rutile type) and organic algol yellow, indofast orange toner of the bisbenzoimidazole pigment group, various quinacridone pigments and peryline pigments, substances containing as their spectral sensitizers yellow or red dyestuffs such as auramine of the diphenylmethane dyestuff group, fluorescein and rose bangale of the xanthene dyestuff group, acridine orange and acridine yellow of the acridine dyestuff group (e.g. zinc oxide sensitized by rose bengale), and weak charge transferring complexes of 2,6-dinitrofluorenone and the like and polyvinylcarbazole, pyrene-formaldehyde condensation products and the like.

Particularly, since the second photoconductive layer 61*c* according to the invention should preferably be of a material which is conductive in response to B color light and can be charged to either of opposite polarities, preferably materials for the layer 61*c* include metal phthalocyanine, ZnO, ZnO-metal phthalocyanine, pigment-sensitized poly-N-vinylcarbazole and CT complexes on the assumption that the B color light is red light.

Another effective type of second photoconductive layer 61*c* is a so-called stratified photoconductive layer which uses a layer of the above-mentioned material as a charge generating layer and has an additional charge transferring layer formed on the charge generating layer and comprising a binder resin and an organic electronic material (electron supplier and electron receiver).

A suitable red or blue pigment or dyestuff may be added to the intermediate layer 61*d*. Typical examples of the pigment are indigo pigments such as indigo and thioindigo, azo pigments such as pyrazolone red, anthraquinone pigments such as indanthrene blue, quinacridone pigments, perylene pigments and other organic pigments, and inorganic pigments such as copper sulfate, potassium ferrosyanate, barium bichromate, cobalt sulfate, cobalt carbonate, trichloromolybudenum, potassium ferricyanide, selenium powder, tin iodide, red iron oxide, silver vermillion, cobalt blue and the like. Examples of the dyestuff are diphenylmethane dyes such as auramine, triphenylmethane dyes such as crystal violet and malachite green, xanthene dyes such as fluorescein, rose bengale and rhodamine B, acridine dyes such as acridine orange, azine dyes such as phenosafranine and methylene violet, thiazine dyes such as phenothiazine and methylene blue, pyrylium salts such as 1,3,5-triphenylthiapyrylium perchrolate, and thiapyrylium salts such as 1,3,5-triphenylthiapyrylium perchrolate.

Such a pigment or a dyestuff will be blue when the B color is red and red when B color is not red. For the intermediate layer 61*d*, a dye is more favorable than a pigment. This is because a dye can be distributed more evenly throughout the layer than a pigment which is in the form of particles and, therefore, the resultant layer may be thinner than one using a pigment.

Where a colored pigment or a dye is added to the intermediate layer 51*d* or where a pigment is added also to the second photoconductive layer 61*c*, the layers 61*c* and 61*d* absorb B color light and, hence, the first photoconductive layer 61*b* may be made of a material sensitive to both A and B color light. Examples of such a material are inorganic substances typified by copper-doped cadmium sulfide, As- or Te-doped amorphous selenium and $As_2Se_3$, and strong charge transferring complex compounds such as those of 2,4,7-trinitrofluorenone, 3.6-dinitrofluorenonmandenonitrile and poly-N-vinylcarbazole, condensated pyrene-formaldehyde copolymer.

The following are more examples of the present invention.

EXAMPLE 3

A Se alloy containing 10 Wt% of Te was vacuum-deposited on a 0.2 mm thick Al substrate (conductive plate) while maintaining the substrate temperature at 65° C. to obtain about a 30 μm thick first photoconductive layer. Then oil modified type urethane resin (F77.60MS available from Mitsui Toatsu Kagaku) was applied to the first photoconductive layer and hardened by drying to form about a 0.5 μm thick intermediate layer. Applied to the intermediate layer was a solution having the following composition:

4-p-dimethylaminophenyl-2,6-diphenylthiapyrylium perchlorate—0.2 g
4,4-bis(diethylamino)-2,2'-dimethyltriphenylmethane—4.0 g
polycarbonate resin (Teijin's Panlite K-1300)—5.8 g
methylene chloride—100 g The mass was dried 15 minutes at 50° C. to form about a 24 μm second photoconductive layer. Finally, the mass was placed 1 minute in saturated vapor of methylene chloride and then dried 10 minutes at 50° C.

Figure 19:
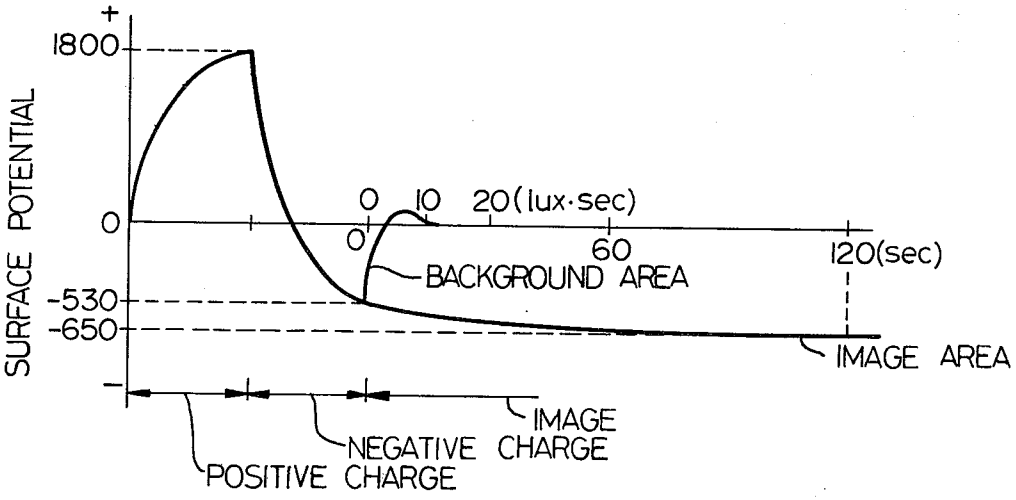
FIGS. 19 and 20 are graphs illustrating practical examples of the present electrostatic copying processes.

A primary charge was applied to the resultant composite member to provide +1800 V or surface potential while illuminating the same evenly (300 μW/cm²) with white light through a Sharp Cut Filter R60 (available from Hoya Glass and absorbing wavelengths of 600 nm and less). Subsequently, the member was deposited with a secondary charge to form a surface potential of −530 V. Imaging of the member caused the surface potential to vary as indicated in FIG. 19.

When the member was mounted in a copying apparatus of the type shown in FIG. 11 and operated to yield multiple copies (copying rate: 40 copies/minute), densities indicated in Table 3 were measured in image and background areas. A developer employed for this process was a mixture of a carrier comprising iron dust of average particle size of 100 μm and covered with teflon to about 2 μm thickness and a toner (Ricoh FT 2000).

TABLE 3

| | Density | |
|---|---|---|
| | Image Area | Background |
| 1st copy | 1.23 | 0.09 |
| 50th copy | 1.27 | 0.09 |
| 100th copy | 1.30 | 0.08 |
| 200th copy | 1.30 | 0.08 |

EXAMPLE 4

Se was vacuum-deposited on a 0.2 mm thick Al plate (conductive substrate) while holding the substrate at room temperature to form about a 28 μm thick first photoconductive layer thereon. An intermediate layer common to that of Example 3 was formed on the first photoconductive layer. Then applied to this intermediate layer was a dispersed solution having the following composition:

cyanine blue—3 g
polycarbonate resin (Teijin's Panlite K-1300)—1 g
methylene chloride—100 g The mass was dried 10 minutes at 50° C. to form a charge generating layer (about 1.5 μm thick) of a second photoconductive layer. A charge transferring layer (about 23 μm) of a second photoconductive layer was then formed by applying to the charge generating layer a dispersion liquid of the following composition:

1,1-bis(p-dibenzylaminophenyl)propane—2.5 g
trinitrofluorenone—2.5 g
polycarbonate resin—5 g
methylene chloride—50 g The charge generating and transferring layers constituted a second photoconductive layer.

Figure 20:
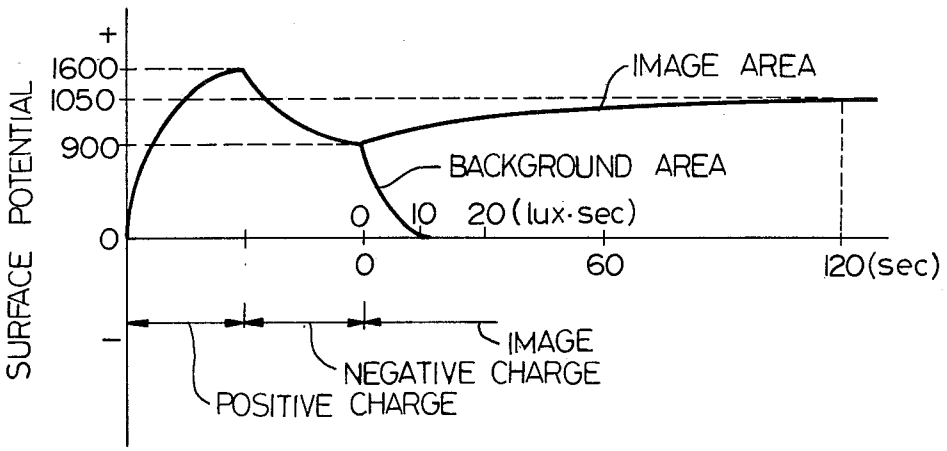

The resultant composite member was used to perform the same copying operation as in Example 3 (employing Hunt's seveloper HUNT 67-160). The surface potential was measured to vary as indicated in FIG. 20. Multicopy operation was carried out under the same conditions as those of Example 3 to provide densities shown in Table 4.

TABLE 4

| | Density | |
|---|---|---|
| | Image Area | Background |
| 1st copy | 1.57 | 0.09 |
| 50th copy | 1.61 | 0.08 |
| 100th copy | 1.63 | 0.08 |
| 200th copy | 1.63 | 0.08 |

In summary, it will be seen that the present invention overcomes the drawbacks of the prior art and provides an electrostatic copying process which produces consistently excellent copies of equal density and contrast. Various modifications will become possible for those skilled in the art after receiving the teachings of the present disclosure without departing from the scope thereof.

What is claimed is:

1. An electrostatic copying process comprising the steps of:

(a) providing a photoconductive member having a conductive substrate, an inner photoconductive layer formed on the substrate and an outer photoconductive layer formed on the inner layer;
(b) forming an electrostatic charge of a first polarity at an interface of the inner and outer layers;
(c) radiating a light image onto the outer layer to form an electrostatic image corresponding thereto at the interface through localized photoconduction; and
(d) repeatedly applying toner to the outer layer to form toner images thereon and transferring the toner images to respective copy sheets;
the process further comprising the step, performed between steps (b) and (c), of:
(e) applying a charge of a second polarity which is opposite to the first polarity to the outer layer;
step (e) comprising applying the charge of the second polarity having a magnitude such that a surface potential on the photoconductive member has the first polarity after step (b) and also step (e);
charge dissipation time constants for the inner and outer layers provided in step (a), a magnitude of the charge of the first polarity applied in step (b) and the magnitude of the charge of the second polarity applied in step (e) being selected in such a manner that an increase in the surface potential as a function of time due to charge dissipation in the inner and outer layers is substantially equal to a decrease in the surface potential as a function of time due to charge leakage in step (d).

2. A process as in claim 1, in which step (a) comprises providing the photoconductive member in such a manner that the inner layer is semiconductive allowing electrostatic charge of the first polarity to move therethrough from the substrate to the interface, step (b) comprising applying electrostatic charge of a second polarity which is opposite to the first polarity to the outer layer.

3. A process as in claim 1, in which step (a) comprises providing the photoconductive member in such a manner that the inner layer is sensitive to light of a first color while the outer layer is sensitive to light of a second color and insensitive to light of the first color, step (b) further comprising uniformly radiating the outer layer with light of the first color.

4. A process as in claim 1, in which step (a) comprises providing the photoconductive member in such a manner that the inner layer is sensitive to light of a first color and insensitive to light of a second color while the outer layer is sensitive to light of the second color, step (b) further comprising radiating the outer layer with light of the second color.

5. An electrostatic copying process comprising the steps of:

(a) providing a photoconductive member having a conductive substrate, an inner photosensitive layer formed on the substrate and an outer photoconductive layer formed on the inner layer;

(b) forming an electrostatic charge of a first polarity at an interface of the inner and outer layers;

(c) radiating a light image onto the outer layer to form an electrostatic image corresponding thereto at the interface through localized photoconduction; and (d) repeatedly applying toner to the outer layer to form toner images thereon and transferring the toner images to respective copy sheets;

the process further comprising the step, performed between steps (b) and (c), of;

(e) applying a charge of a second polarity which is opposite to the first polarity to the outer layer;

step (e) comprising applying the charge of the second polarity having a magnitude such that a surface potential on the photoconductive member has the first polarity after step (b) and the second polarity after step (e);

charge dissipation time constants for the inner and outer layers provided in step (a), a magnitude of the charge of the first polarity applied in step (b) and the magnitude of the charge of the second polarity applied in step (e) being selected in such a manner that an increase in the surface potential as a function of time due to charge dissipation in the inner and outer layers is substantially equal to a decrease in the surface potential as a function of time due to charge leakage in step (d).

6. A process as in claim 5, in which step (a) comprises providing the photoconductive member in such a manner that the inner layer is semiconductive allowing electrostatic charge of the first polarity to move therethrough from the substrate to the interface, step (b) comprising applying electrostatic charge of a second polarity which is opposite to the first polarity to the outer layer.

7. A process as in claim 5, in which step (a) comprises providing the photoconductive member in such a manner that the inner layer is sensitive to light of a first color while the outer layer is sensitive to light of a second color and insensitive to light of the first color, step (b) further comprising uniformly radiating the outer layer with light of the first color.

8. A process as in claim 5, in which step (a) comprises providing the photoconductive member in such a manner that the inner layer is sensitive to light of a first color and insensitive to light of a second color while the outer layer is sensitive to light of the second color, step (b) further comprising radiating the outer layer with light of the second color.

* * * * *